US011206926B1

(12) United States Patent
Moeller

(10) Patent No.: US 11,206,926 B1
(45) Date of Patent: Dec. 28, 2021

(54) TRUSS-MOUNTED ATTIC STORAGE SYSTEM

(71) Applicant: David W Moeller, Flowery Branch, GA (US)

(72) Inventor: David W Moeller, Flowery Branch, GA (US)

( * ) Notice: Subject to any disclaimer, the term of this patent is extended or adjusted under 35 U.S.C. 154(b) by 0 days.

(21) Appl. No.: 17/300,124

(22) Filed: Mar. 15, 2021

Related U.S. Application Data

(60) Provisional application No. 63/101,742, filed on May 13, 2020.

(51) Int. Cl.
*A47B 96/06* (2006.01)
*A47B 96/14* (2006.01)

(52) U.S. Cl.
CPC ..... *A47B 96/06* (2013.01); *A47B 96/1433* (2013.01)

(58) Field of Classification Search
CPC ..... A47B 96/06; A47B 96/1433; A47B 2087/0238; A47B 96/061; A47B 96/063; A47B 96/068; A47B 96/1441; A47F 5/08; A47F 5/0838; A47F 5/0846; A47F 5/0853; E04G 3/22; E04G 7/302; E04G 5/041; E04G 5/004; E04G 5/00; F16M 13/02; F16M 13/027
USPC ..... 52/36.4–36.6, 39, 653.1, 708
See application file for complete search history.

(56) References Cited

U.S. PATENT DOCUMENTS 1,217,603 A * 2/1917 Jester ..... E04B 2/7457 52/357
1,871,913 A * 8/1932 Patterson ..... E04B 1/24 52/280
1,976,967 A * 10/1934 Scullin ..... E04B 1/24 52/236.3
3,537,221 A * 11/1970 Helfman ..... F16B 9/058 52/289
3,900,110 A * 8/1975 Soroka ..... A47F 5/0006 211/113
4,122,762 A * 10/1978 Williams ..... E04B 9/12 248/343
4,566,240 A * 1/1986 Schilger ..... E04C 5/065 52/334
5,239,790 A * 8/1993 Fetzer ..... A47B 96/025 312/245
5,406,895 A * 4/1995 Suess ..... A47B 96/021 108/149
5,511,353 A * 4/1996 Jones ..... E01C 5/005 52/236.1
5,638,653 A * 6/1997 Rossi ..... E04F 19/062 52/36.6
6,286,691 B1 9/2001 Oberhaus
6,725,608 B1 * 4/2004 Kraus ..... A47B 96/02 52/22
6,820,722 B2 * 11/2004 Severt ..... E04G 5/06 182/150
7,389,614 B2 6/2008 Sullivan
7,591,105 B2 9/2009 Balser
(Continued)

*Primary Examiner* — Jonathan Liu
*Assistant Examiner* — Devin K Barnett
(74) *Attorney, Agent, or Firm* — James K. Poole, Esq.

(57) ABSTRACT

A truss-mounted attic storage system that is formed by the assembly and mounting of a set of brackets and bars to an adjacent pair of trusses to form a horizontal shelf or rack that is secured in place. The shelf or rack can then have a crate, box or tote containing items to be stored set on and held by the shelf or rack.

12 Claims, 5 Drawing Sheets

(56) References Cited

U.S. PATENT DOCUMENTS 7,712,716 B2 * 5/2010 Riblet ..... E04G 5/06 248/246
7,878,317 B2 * 2/2011 Dohrendorf ..... B65G 1/08 193/37
8,096,087 B2 1/2012 Wainland
8,540,201 B2 * 9/2013 Gadd ..... E04B 1/2608 248/300
8,931,233 B2 * 1/2015 Cooper ..... E04B 1/24 52/655.1
8,960,457 B2 * 2/2015 Brisendine ..... A47B 43/006 211/113
9,004,433 B2 * 4/2015 Krieger ..... B60N 3/102 248/311.2
9,097,005 B2 * 8/2015 Cave ..... E04B 5/43
9,138,077 B2 * 9/2015 Found ..... A47B 88/40
9,435,113 B2 * 9/2016 Brandt ..... E04B 5/43
9,494,273 B2 * 11/2016 Wang ..... F16B 7/18
9,534,374 B1 * 1/2017 Mogck ..... E04B 1/40
9,732,522 B2 8/2017 Brandt et al.
10,508,467 B2 * 12/2019 Francis ..... E04H 15/56
10,550,568 B2 * 2/2020 Ndobo-Epoy ..... E04B 1/7675
2002/0148188 A1 * 10/2002 Rizzotto ..... E04B 1/24 52/653.1
2005/0017142 A1 * 1/2005 Ogden ..... E04G 11/365 248/247
2005/0258722 A1 * 11/2005 Sullivan ..... E04G 23/027 312/245
2006/0157626 A1 * 7/2006 Wooten ..... A47B 96/061 248/248
2006/0277832 A1 * 12/2006 Balser ..... A47B 88/40 52/29
2007/0235611 A1 * 10/2007 Riblet ..... E04G 5/062 248/248
2008/0048080 A1 * 2/2008 Riblet ..... E04G 5/061 248/235
2012/0132262 A1 * 5/2012 Sagayama ..... H02S 20/23 136/251
2015/0226451 A1 * 8/2015 Crowley ..... A47B 43/003 248/676
2017/0122493 A1 * 5/2017 Dammann ..... A47G 25/0692
2018/0223548 A1 * 8/2018 Brownmiller ..... E04G 5/16
2021/0054646 A1 * 2/2021 Volin ..... A01K 1/03

* cited by examiner

TRUSS-MOUNTED ATTIC STORAGE SYSTEM

CROSS-REFERENCE TO RELATED APPLICATIONS

This utility application claims the benefit of Applicant's provisional application U.S. Ser. No. 63/101,742, filed on Mar. 18, 2020, This application is not a result of federally sponsored research or development.

BACKGROUND OF THE INVENTION

1. Field of the Invention

The present invention relates to the field of attic storage systems and, more specifically, to a set of hardware that mounts to a pair of wood webs that are part of adjacent trusses located in the attic area between the ceiling and roof of a typical wood framed house. The set of hardware, once assembled and secured, forms a shelf that will hold a tote or other large storage container safely.

2. Description of Relevant Art

For many homeowners the ability to store household items that are bulky and only occasionally used can be a problem. Examples of these types of household items are holiday decorations, artificial Christmas trees and other similar seasonal items. Garages are often sized so that there is only limited room for the placement of shelving or cabinets for storage along the side and/or front walls if the owner plans to park their vehicle(s) in the garage. Due to the additional building costs, many homes do not feature basements which would provide sufficient storage space for such bulky items. As most homes are of frame construction and feature peaked roofs, they do have an attic area that is formed in the open space created by the trusses that support the sloped roof above the ceiling of the interior space of the home. This attic area is often used as the location of the home's HVAC system and as such is made to be accessible for service or repairs via a pull-down ladder or similar access method. With the existence of both an attic space and a built-in access system, many homeowners choose to utilize this space as their primary storage area for such infrequently used items.

Patents of Sullivan, U.S. Pat. No. 7,389,614, Wainland, U.S. Pat. No. 8,096,087, Brandt et al., U.S. Pat. Nos. 9,435,113 and 9,732,522, and Mogck et al., U.S. Pat. No. 9,534,374, describe different mounting systems that allow for the area over or between the bottom chords of the trusses, that run horizontally across the bottom of the attic area, to be covered with plywood, or other similar solid sheeting, to form a floor that can be walked on and will allow items such as boxes, totes, crates, etc. to be laid out in a single layer or stacked, if the boxes, crates or totes facilitate stacking, on this floor for storage. While this does allow for storage it requires that either the items in storage be spread out to provide easy access to individual items or that open space be left in the attic to allow for the stacked items to be unstacked to select the specific box, crate or tote desired.

Patents of Balser, U.S. Pat. No. 7,591,105 and Dohrendorf, U.S. Pat. No. 7,878,317 describe a system of roller or skate wheel conveyors that are mounted on supports above the bottom chords of the trusses and have a series of boxes, crates or totes supported on them. These systems do not create a surface that can be walked on but do support the boxes, crates or totes holding items and allow them to be moved laterally across the bottom of the attic space to provide access.

Suess' U.S. Pat. No. 5,406,895 describes a trough-like shelf that is designed to have its width sit within and be mounted to the V-shape space formed between the edges of two adjacent webs within the structure of an individual truss and its length to run across, and be mounted to, the same location of two or more adjacent trusses. The shelf can either be a solid sheet of shaped material or constructed of a rigid mesh made from wires. The front and back edges will flex or pivot to align with the angle of incline of the edges of the two adjacent webs. This shelf can only be affixed in a specific location between the adjacent webs as the width of the bottom of the shelf will only fit in the place where the horizontal distance between the two adjacent webs is the same as the width of the flat bottom section of the shelf.

Oberhaus et al., U.S. Pat. No. 6,286,691, describes a rigid wire mesh single or multiple shelving system that is suspended from a set of hangers mounted to the top chords, or a combination of the top chords and webs, of a pair of trusses. The system can either be attached parallel to and between an adjacent pair of trusses or perpendicular to and across two or more trusses. If mounted parallel to and between adjacent trusses and to one side of the roof peak, then the slope of the roof would limit the length and/or number of shelves that could be fitted due to the reduced length of the down slope hanger. If mounted parallel between adjacent trusses but centered under the roof peak, the length and number of shelves that could be fitted would be improved, but by being placed in such a manner the shelves themselves could act as a partial or full barrier to safe passage down the length of the central open area formed between the inner pairs of webs of the series of trusses. If mounted perpendicular, the length and number of shelves that could be fitted would also be improved, but depending on the slope of the inner webs, which slope towards the peak of the roof, the shelves would either have to be mounted with a significant distance between the bottom shelf and the webs or have shelves removed above the point where the webs would intersect the backs of the shelves.

In view of the foregoing disadvantages and limitations found in the prior art for an attic storage system, there remains a need for an improved hardware device to provide for attic storage.

SUMMARY

The truss-mounted attic storage system described herein is a kit comprising a set of hardware components and a set of fasteners that are designed to be mounted on the exposed tension webs of the trusses in an attic of a typical frame-construction residence. By a kit, it is meant that the components provided are designed and adapted to be assembled in the intended location to provide a storage system as claimed. The system will generally attach to the tension webs of two adjacent trusses with the front or face of the system oriented towards the center open area of the attic. The system can be attached across a range of elevations from the point just above the location where the base of the tension web is attached to the bottom chord to a point near the spot where the top of the tension web attaches to the top chord. The option to be attached across a range of elevations allows for multiple storage systems to be attached at a desired spacing from the base to the top of the tension web.

Once attached, the system creates two or more parallel linear support surfaces that will support a box, crate or tote and its contents.

The truss-mounted attic storage system comprises three types of shaped metal components that are designed and adapted to connect with each other and the truss components of a roof to form the storage system. The first metal component is the web-mountable bracket. The web-mountable bracket is designed in a U-shape or rectangular cross section so that it will attach to the edge and both sides of the 2×4 or 2×6 lumber tension web portion of the truss. The bracket is designed to be attached at a range of angles so that the face of the bracket is securely held in a vertical orientation, by a series of screw or nail fasteners, while the tension web it is attached to is sloped at an angle, typically vertical to 45 degrees from vertical, from the top chord near the roof peak down to the point where it is attached to the bottom chord. The basic system generally uses two of the web-mountable brackets that are attached to the tension webs of two adjacent trusses at the same elevation on the adjacent tension webs. (Once attached, they can be considered web-mounted brackets.) The face of the bracket is fitted on its lower edge with a U-shaped saddle that is designed to hold and securely support the second component of the system. The saddle is substantially perpendicular to the face of the bracket. In the preceding section the term securely is used to mean that the structural strength of the bracket and the holding and shear strength of the fasteners attaching the bracket to the tension web are such that a load greater than about 200 pounds can be safely supported.

The second component of the truss-mounted attic storage system is the cross bar. The cross bar is a rectangular cross-sectional shaped metal tube that has a series of spaced holes drilled or punched down the lengths of the top and bottom surfaces of the cross bar. The cross bar could be made with a U-shaped cross section, open edge towards the bottom, in place of the rectangular shape depicted in the figures. For the basic system the cross bar, with one of the surfaces with holes oriented upward, is placed between and into the saddles of two web-mounted brackets and is held at both ends by these saddles of the two web-mounted brackets. A carriage bolt or screw that passes through the aligned holes in the face of the saddle and face of the bracket is then inserted and tightened so that the saddles of both brackets clamp down on the ends of the cross bar to secure it in place. Once the cross bar is secured, the third and final component of the system can be attached.

The third component of the system is a set of at least two load support bars. The load support bars are U-shaped, with notches cut into the sides that allow the bar to have a close tolerance fit over the cross bar. The load support bars have a hole drilled or punched and countersunk into the top face of the load support bar at the location of the notch. For attachment, the load support bar notch is placed substantially perpendicular over the cross bar at the location of one of the holes in the top of the cross bar. The cross bar is then set into the notch in the load support bar and the load support bar lowered until the cross bar is fully seated into the notch in the load support bar. A flat head sheet metal screw or carriage bolt is then inserted through the hole in the load support bar and driven into the hole, or through the holes in the case of the carriage bolt, in the cross bar to secure them together. For the basic system, two load support bars are attached to the cross bar in this manner to form a pair of parallel supports for the crate, box or tote that will be placed on them.

Once assembled and mounted to a pair of adjacent tension webs, the system is ready to have the desired items packed up and placed on the load support bars for easily accessible storage by the homeowner.

Alternative configurations of the system include, but are not limited to, the following variations:

1. Attaching the two web-mounted brackets not on adjacent trusses but with one or more trusses between them and using a cross bar long enough to bridge the longer span created between them. Then a sufficient number of load support bar pairings are attached to produce a system that will hold multiple crates, boxes or totes.
2. Attaching three or more load support bars to the cross bar so that narrower crates, boxes or totes can be well supported.
3. Attaching three or more web-mounted brackets to the tension webs of three or more adjacent trusses and inserting a cross bar between each pairing so that the ends of the adjacent cross bars share and are held and secured by the web-mounted bracket. Then, in turn two or more load support bars can be mounted to each cross bar.

The described truss-mounted attic storage system can be easily installed using basic hand tools (e.g., level, pencil, screwdriver and pliers) and is designed to be assembled in more than one configuration and/or at a range of elevations so that the user can adapt the system to meet their specific needs. The pieces as described can be made by cutting or punching and bending or stamping sheet metal. Although discussed in terms of a preferred embodiment of metal components, these components could also be made by molding or casting them from metal or molding and/or extruding them in other materials such as fiber reinforced thermoplastics. As a result, the known deficiencies of the current attic storage devices are overcome. While the kits described above can be packaged and marketed to do-it-yourself homeowners, they could also be sold to housing remodeling contractors and builders, perhaps at wholesale for the latter.

BRIEF DESCRIPTION OF THE DRAWINGS

The invention will be better understood and aspects other than those set forth above will become apparent when consideration is given to the following detailed description, the appended claims and drawings. The same numerals are used to designate like components in each of these figures. Such description makes reference to the annexed drawing wherein:

DETAILED DESCRIPTION OF PREFERRED EMBODIMENTS

In general, the following description adopts a terrestrial frame of reference, in which the bottom of a component is considered to be the side nearest the floor or earth when in normal use, and the top being the side opposite and facing upward. The term "face" is used to identify the portion that is in closest proximity to the peak of the roof. The term "back" is used to identify the reverse portion that is oriented towards the exterior wall of the house. The term "and/or" is used in the conventional sense, in which "A and/or B" indicates that A or B, or both, may be present. Where dimensions or angles are given, they are approximate rather than precise, as required to fit a variety of attic installations. Similarly, when one component is "substantially" perpendicular to another, the angle between them can be slightly more or less than 90 degrees.

Figure 1:
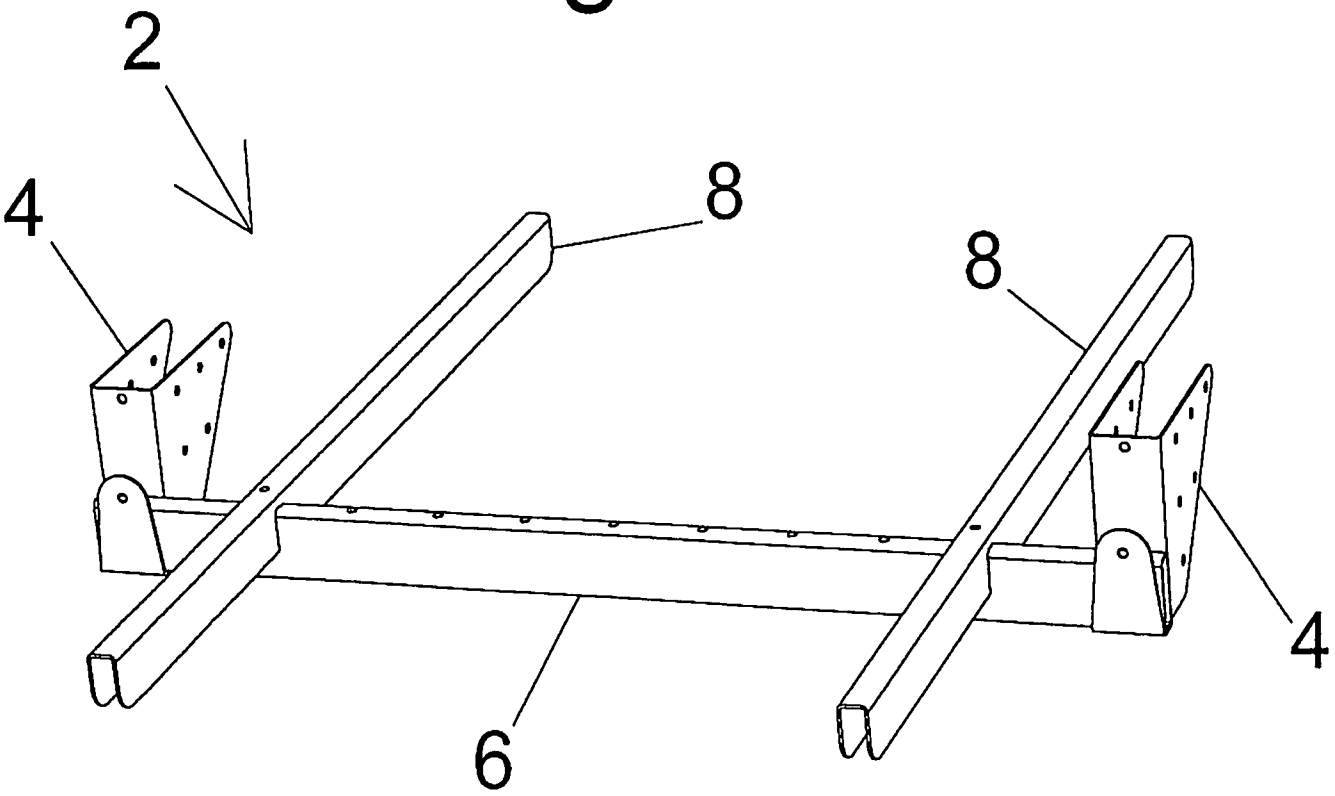
FIG. 1 is an oblique view of the components assembled to form the described truss mounted attic storage system.

With reference to FIG. 1, the assembled truss-mounted attic storage system (2) is shown with two web-mounted brackets (4) holding both ends of the cross bar (6) and two load support bars (8) attached to the cross bar (6). For clarity, the holes for the various fasteners used are shown but not the fasteners themselves. This is the simplest embodiment, using two brackets (4), one cross bar (6) and two load support bars (8).

Figure 2:
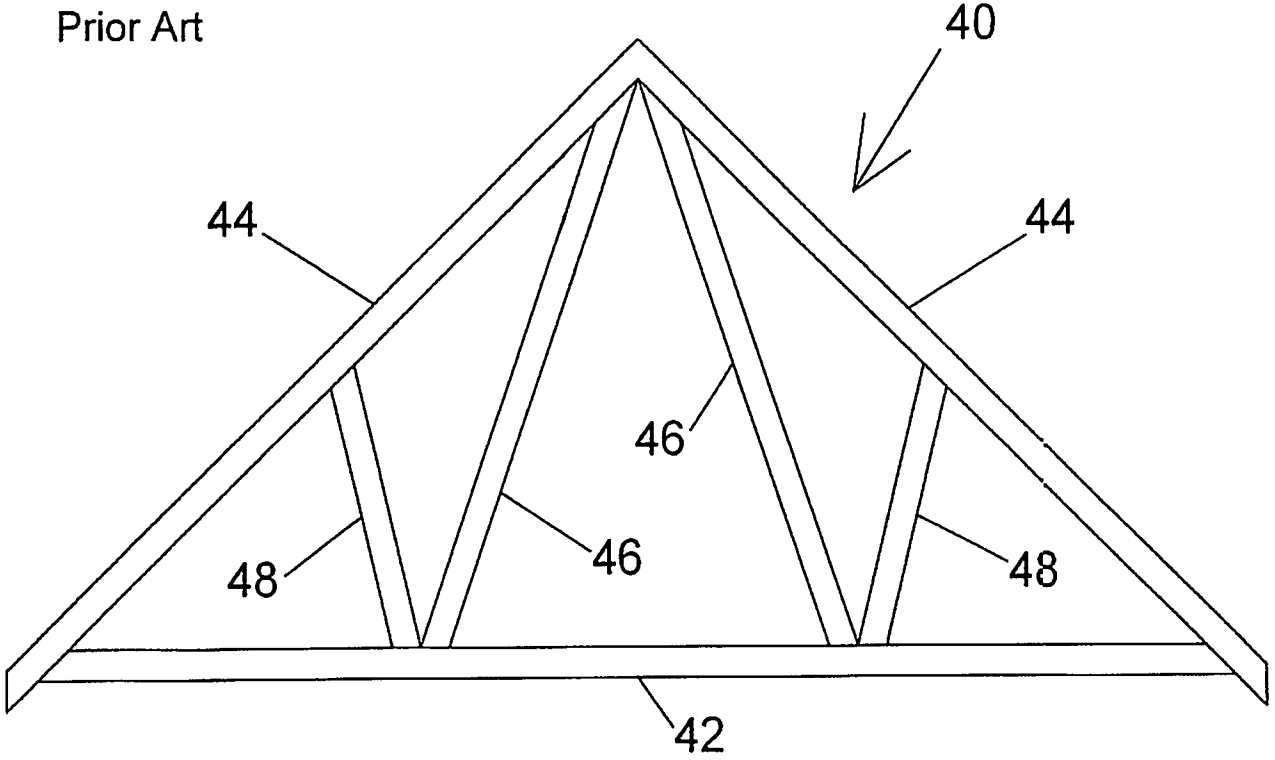
Figure 2 Prior Art
FIG. 2 is a side view showing the parts that form a typical (prior art) wooden roof truss.

With reference to FIG. 2, a side view of a typical wooden roof truss (40) is shown. The basic form of the truss (40) is created by the triangle formed between the horizontal bottom chord (42) and the two inclined top chords (44). The bottom chord (42) provides the load bearing structure to which the panels used to form the ceiling of the living space below are attached to the bottom edge and safely suspended. The top chords (44) are the load bearing members that have panels attached to their outer edges and in turn have the shingles or other roofing materials attached to them to form the roof of the house. To ensure that the truss (40) is capable of both safely supporting the weights of the ceiling and roofing and to endure potential wind and snow loads from storms, a series of tension webs (46) and compression webs (48) are secured between the bottom chord (42) and each of the top chords (44). This naming convention used is based on "anatomy of a truss" by Fink, which was accessed from URL www.localarchitectsdirect.co.uk, and represents the prior art or typical structural components found in an attic.

Figure 3:
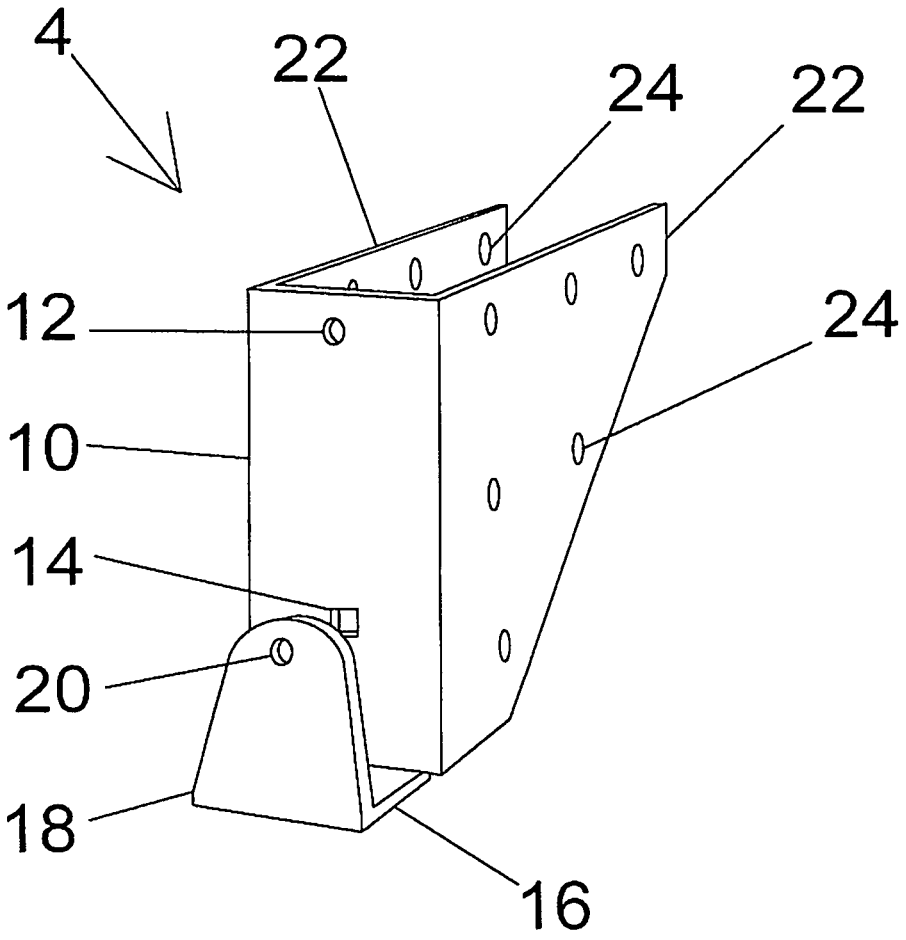
FIG. 3 is an oblique view of the described web-mountable bracket.

With reference to FIG. 3, the web-mountable bracket (4) is shown. The web mountable bracket (4) features a hole (12) in the upper edge of the bracket face (10) that allows for a screw to be inserted and driven into the face of the tension web (not shown) to initially hold the web-mounted bracket (4) in place. If the tension web (not shown) is sloped, then a carriage bolt (not shown) is inserted from the back side of the bracket face (10) through the square hole (14) and then through the hole (20) in the saddle face (18) of the saddle (16). The nut (not shown) would then be loosely attached to the end of the carriage bolt (not shown). If the tension web (not shown) is oriented vertically, then no carriage bolt is inserted. The web-mountable bracket (4) is then pivoted so that the bracket face (10) is vertical. If necessary, the screw (not shown) already driven through the hole (12) in the bracket face (10) can be loosened to allow the web-mounted bracket (4) to pivot. Once vertical, screws (not shown) are driven through the holes (24) located in both bracket sides (22) that overlap the sides of the tension web (not shown) to secure it in the correct alignment. Once both of the web-mounted brackets (4) are secured, the cross bar (not shown) is placed so that the ends rest in the saddle (16) and then the cross bar (not shown here; see FIG. 1) is secured by either tightening the nut (not shown) on the previously inserted carriage bolt (not shown) or by inserting a screw (not shown) through the hole (20) and square hole (14) and driving it into the vertical tension web (not shown). The saddle (16) is substantially perpendicular to the bracket face (10) of the bracket (4).

Figure 4B:
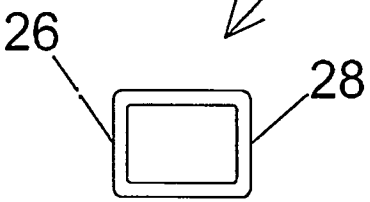
FIGS. 4A and 4B are top and end views of the described cross bar.
Figure 4A:
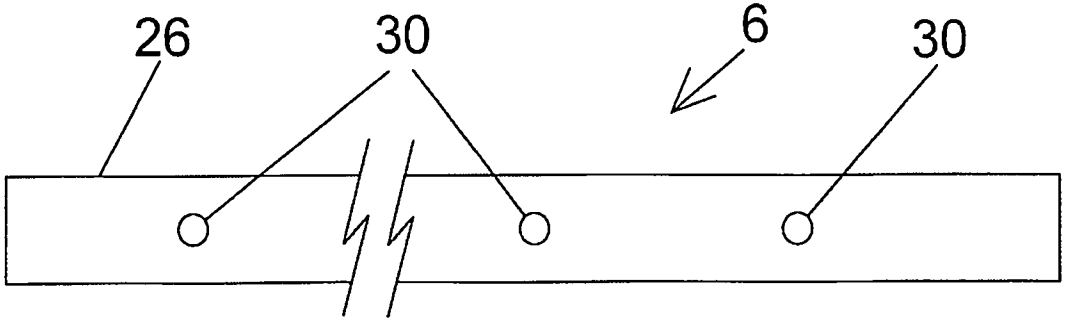

With reference to FIGS. 4A and 4B, the cross bar (6) is shown. The cross bar (6) as depicted is a rectangular metal tube but could instead be U-shaped, with the open edge oriented down, and still perform its function. The top face (26) and bottom face (28) of the cross bar (6) have a series of holes (30) punched or drilled into them so that they align with each other. The minimum length of the cross bar (6) will typically be about 16 or 24 inches in length (the typical spacing between roof trusses) but could be made in any range of lengths as needed. The spacing of the holes (30) will be from about 2 to 6 inches across the top face (26) and bottom face (28) so that the spacing between the pair of load support bars (not shown) can be adjusted to provide a range of spacing options.

Figure 5B:
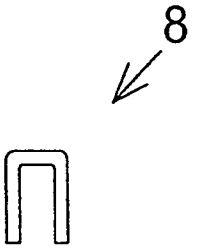
FIGS. 5A, 5B and 5C are the side, end and top views of the described load support bar.
Figure 5A:
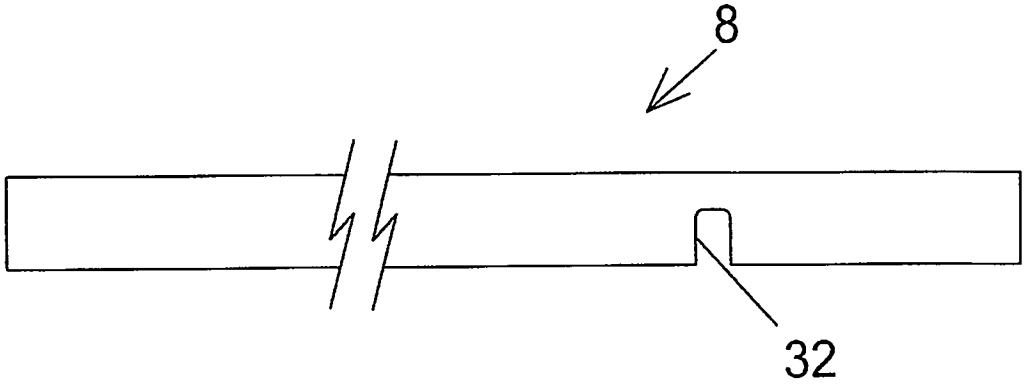
Figure 5C:
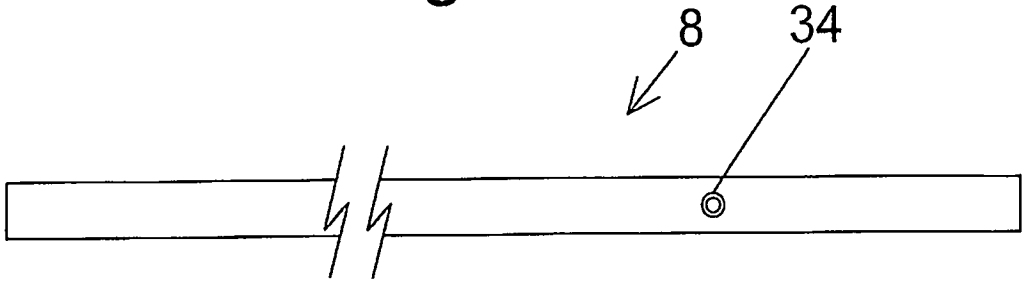

With reference to FIGS. 5A, 5B and 5C, the load support bar (8) is shown. The load support bar (8) is depicted as U-shaped but could instead be a rectangular or square tube shape and still perform its function. Both sides of the load support bar (8), and bottom as well if rectangular or square tube shaped, have a notch (32) cut into them that is sized to fit closely over the cross bar (not shown). The top surface of the load support bar (8) has a round hole (34) drilled or punched and countersunk above the midpoint of the notch (32). The load support bar (8) is attached to the cross bar (not shown) by aligning the notch (32) with the cross bar (not shown) at a location of one of the holes in the cross bar (not shown). Once aligned and seated over the cross bar (not shown) a flat head sheet metal screw is driven through the hole (34) into the hole in the cross bar (not shown) to attach it. If a carriage bolt is used as the fastener, then the hole (34) would be square shaped and not countersunk.

In the foregoing description, certain terms have been used for brevity, clarity and understanding. All equivalent relationships to those illustrated in the drawings and described in the preferred embodiment are to be encompassed by this present invention to produce the intended results. It is also to be understood that the following claims are intended to cover all of the generic and specific features of the invention herein described, and all statements of the scope of the invention which, as a matter of language, might be said to fall therebetween.

Having thus described and disclosed preferred embodiment of my invention, what I claim as my invention is:

1. A truss-mounted attic storage system configured to be used in a residential attic, comprising:

a) at least two web-mountable brackets, each having a concave U-shaped or rectangular portion configured to be attached to one edge and opposed sides of a corresponding tension web portion of a corresponding attic truss, each concave U-shaped or rectangular portion comprising a front face and two opposed sides perpendicular to the front face, a U-shaped concave saddle attached to a lower face of each bracket respectively, with a horizontal lower portion of the U-shaped concave saddle being substantially perpendicular to said U-shaped or rectangular portion of each bracket respectively and a vertical portion of the U-shaped concave saddle being spaced apart from and parallel with said front face of each concave U-shaped or rectangular portion respectively, wherein each bracket comprises a plurality of holes in each side thereof to facilitate attachment of said at least two brackets to said corresponding tension web portions of said corresponding attic trusses respectively, and at least one hole in each front face of each bracket respectively to further facilitate attachment to said corresponding tension web portions, and a hole in each U-shaped concave saddle configured to receive a fastener to enable a cross bar to be secured within said U-shaped saddles;

b) at least one cross bar having a length, a width, a rectangular cross-section, and two series of holes therein, configured to be secured within said saddles of the at least two brackets, and c) at least two load support bars each having a U-shaped cross-section and a notch cut into a lower side thereof, wherein each notch is configured to receive a substantial portion of the width of said at least one cross bar therein to interlock the at least two load support bars securely with said at least one cross bar to support items for storage.

2. The truss mounted attic storage system of claim 1, wherein said corresponding tension web portions are two adjacent tension web portions of said corresponding attic trusses.

3. The truss mounted attic storage system of claim 1, wherein said at least one cross bar is designed and adapted to be attached to more than two corresponding adjacent tension web portions of said corresponding attic trusses.

4. The truss mounted attic storage system of claim 1, wherein the at least two load support bars are sufficient to withstand a predicted or expected load on said truss-mounted attic storage system when fastened to the at least one cross bar between two corresponding adjacent tension web portions of said corresponding trusses.

5. The truss mounted attic storage system of claim 1, wherein said plurality of holes in each side of each bracket permit attachment of each bracket to the corresponding tension web portion with each corresponding tension web portion being at a corresponding acute angle from a vertical plane, using mechanical fasteners.

6. The truss mounted attic storage system of claim 5, wherein each corresponding acute angle is in the range of from about 0 degrees to about 45 degrees from the vertical plane.

7. The truss mounted attic storage system of claim 1, wherein for each bracket:

the hole of said U-shaped concave saddle is in the vertical portion of said U-shaped concave saddle and is substantially aligned with one of the at least one hole in the front face of said bracket to facilitate insertion of a fastener and secure installation of said at least one cross bar.

8. The truss mounted attic storage system of claim 1 wherein at least one of said at least two web-mountable brackets, at least one cross bar, and at least two load support bars is formed of metal.

9. The truss mounted attic storage system of claim 1 wherein said at least one cross bar has at least a second set of two holes therein, positioned to align with holes in the at least two load support bars to securely attach the at least two support bars to the at least one cross bar with mechanical fasteners.

10. The truss mounted attic storage system of claim 1, further comprising mechanical fasteners to securely attach the truss mounted storage system to the tension web portions of the corresponding trusses, securely attach the at least two brackets to the at least one cross bar, and securely attach the at least two load support bars to the at least one cross bar to provide a secure load-bearing installation.

11. The truss-mounted attic storage system of claim 1, wherein each of the at least two web-mountable brackets are attached to the one edge and the opposed sides of the corresponding tension web portion of the corresponding attic truss, at least one cross bar is secured into said saddles of said at least two brackets and the at least two load support bars are installed and interlocked with said at least one cross bar and to form a horizontal load-bearing installation.

12. A method of installing the truss-mounted attic storage system of claim 1, comprising the steps of:

(a) securely attaching the at least two web-mountable brackets to at least two corresponding tension web portions of the corresponding attic trusses using mechanical fasteners;

(b) inserting and securing by using fasteners to clamp the at least one cross bars into said saddles of said at least two web-mounted brackets; and c) installing the at least two load support bars on the at least one cross bar in an interlocking manner and securing said at least two load support bars in place on the at least one cross bar with mechanical fasteners to form a horizontal load-bearing installation.

* * * * *